US005533653A

United States Patent [19]

Kaufman

[11] Patent Number: 5,533,653

[45] Date of Patent: Jul. 9, 1996

[54] COMBINATION TOTEBAG AND TOWEL HAVING AN ADVERTISING MEDIUM AND METHOD OF MAKING THE SAME

[76] Inventor: Mark S. Kaufman, 200 Ingelside Dr., Stamford, Conn. 06903

[21] Appl. No.: 247,042

[22] Filed: May 20, 1994

[51] Int. Cl.[6] ..... A45C 15/00; A45F 4/00

[52] U.S. Cl. ..... 224/577; 383/4; 383/38

[58] Field of Search ..... 224/151, 191, 224/223, 237, 242, 245; 383/4, 38, 40; 190/1, 2, 107, 115

[56] References Cited

U.S. PATENT DOCUMENTS

| | | | |
|---|---|---|---|
| 1,256,783 | 2/1918 | Fuller . | |
| 2,045,784 | 6/1936 | Leve . | |
| 2,264,471 | 12/1941 | Glenn | 5/344 |
| 2,344,010 | 3/1944 | Walsh | 2/69 |
| 2,783,473 | 3/1957 | Humpeler | 2/69 |
| 3,176,315 | 4/1965 | Freund | 2/69 |
| 4,097,944 | 7/1978 | Yulish | 5/344 |
| 4,127,155 | 11/1978 | Hydorn | 383/38 |
| 4,154,323 | 5/1979 | Sneider | 190/2 |
| 4,188,988 | 2/1980 | Agyagos | 150/1.7 |
| 4,375,111 | 3/1983 | Hall | 5/419 |
| 4,404,687 | 9/1983 | Hager | 383/4 |
| 4,466,516 | 8/1984 | Sicoli et al. | 190/2 |
| 4,516,668 | 5/1985 | Grayek | 190/2 |
| 4,600,091 | 7/1986 | McLeod | 190/2 |
| 4,634,618 | 1/1987 | Greer et al. | 428/81 |
| 4,967,986 | 11/1990 | Schildkraut | 224/250 |
| 4,984,906 | 1/1991 | Little | 383/4 |
| 5,018,229 | 5/1991 | Eberhart | 5/417 |
| 5,072,467 | 12/1991 | Hunt | 5/417 |
| 5,346,308 | 9/1994 | Buhot et al. | 383/4 |
| 5,390,381 | 2/1995 | LaMantia | 383/4 |

*Primary Examiner*—Henry J. Recla
*Assistant Examiner*—Gregory M. Vidovich

[57] ABSTRACT

A combination totebag and mat are disclosed formed from a generally rectangular-shaped towel having an upper edge and a plurality of panels, each panel having an upper edge, attached to the towel. The upper edge of the towel is substantially adjacent to the upper edges of the panels. A first panel is attached to the towel along all four edges. A second, third and fourth panel are attached to the first panel along three edges, leaving the upper edge open to form pockets between the panels. As such, there is a pocket formed between the first and second panel, the second and third panel, and the third and fourth panel. When the towel is in the unfolded position, the panels are underneath the towel and hidden from view. To place the towel in the totebag, the towel is folded back onto itself such that it is substantially overlying the fourth panel and is substantially the shape and size of the fourth panel. The pocket between the third and fourth panel is then inverted, substantially enclosing the towel in the totebag. As such, one may place articles in the other pockets, and there is reduced fear of these articles falling out due to the depth and placement of these pockets. Indicia, such as advertising, can be displayed on the towel and on at least one of the panels, such that when the towel is placed inside the totebag, at least one of the outer panels of the totebag displays advertising.

24 Claims, 5 Drawing Sheets

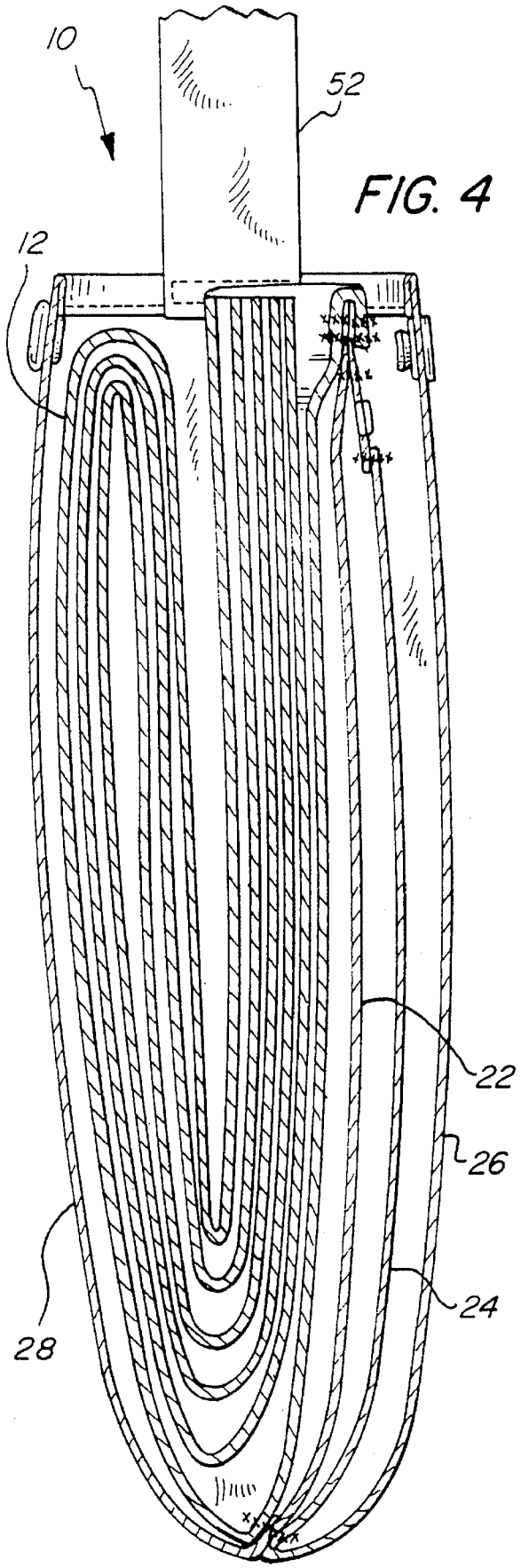
FIG. 4
FIG. 5
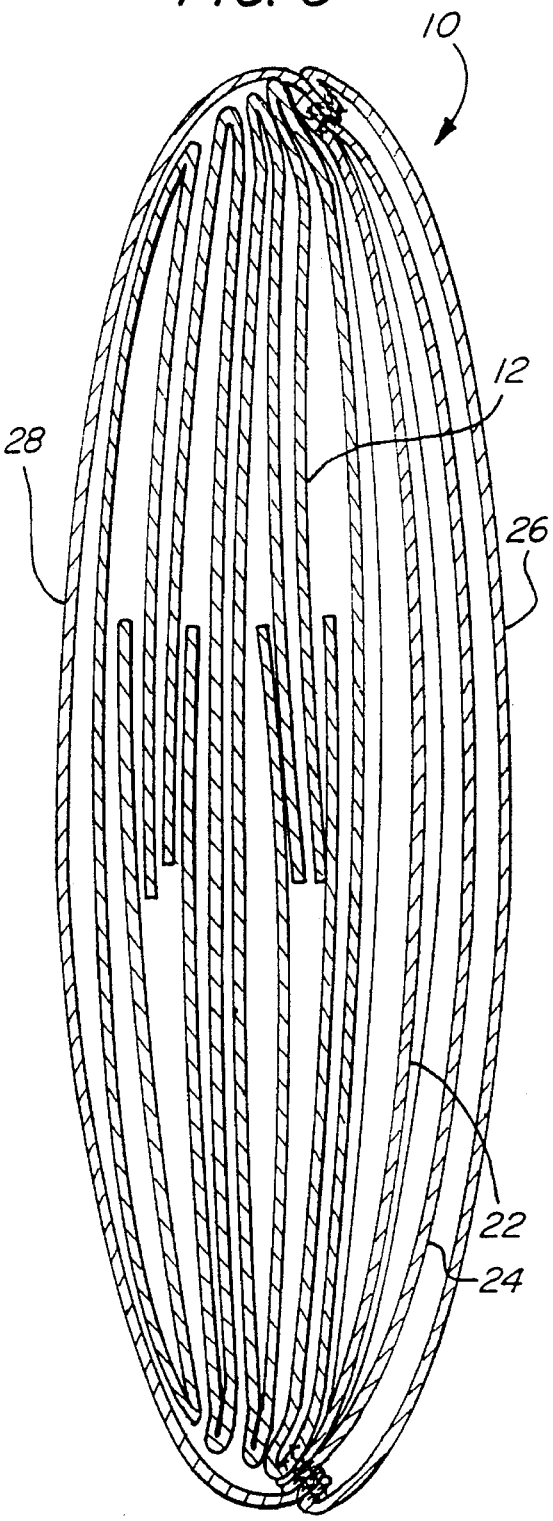

COMBINATION TOTEBAG AND TOWEL HAVING AN ADVERTISING MEDIUM AND METHOD OF MAKING THE SAME

FIELD OF THE INVENTION

The present invention relates to beach gear and, more particularly, a combination totebag and towel, for sunbathing and the like, which is conveniently portable.

BACKGROUND OF THE INVENTION

Combination beach towels and hand bags which attempt to facilitate traveling to and from the beach are known. One such combination hand bag and towel, or mat, is shown in U.S. Pat. No. 4,375,111 to Hall. This combination handbag and mat is useful for traveling to and from the beach by reducing the number of separate items one must carry. For example, the handbag, sometimes called a totebag, is suitable for containing the towel and it has at least one pocket in which to place other personal items such as sunglasses and suntan lotion.

This Hall totebag, however, has drawbacks. One drawback is that the pocket for containing personal items is located on the outside of the bag. As such, the contents of the pocket can easily and undesirably be emptied when folding or placing the towel in the bag. As such, the user is sometimes forced to empty the pocket before inserting the towel into the bag.

A second drawback associated with this handbag is that the pocket extends only a short distance up a wall of the handbag. Consequently, the volume of the pocket is not as large as may be desired.

U.S. Pat. No. 4,516,668 to Grayek attempts to overcome some of the deficiencies of the prior art by disclosing pockets which extend the length of the handbag, as shown in FIG. 11 of the patent. The '668 patent has a drawback in that, when the towel is expanded into a position for a person to sit, the seams and the cords of the totebag are plainly noticeable, regardless of which side of the towel is placed adjacent to the beach or other surface, thus revealing to passersby the location of the totebag. As such, the location of valuable personal items such as keys and money can be revealed.

The known combination handbag and towels have a further drawback in that they are generally not used as advertising media in the fullest possible manner. Because at least some beaches tend to be very crowded during the summer and beachgoers oftentimes stay at the beach for long periods of time, advertisers are not taking the fullest possible advantage of every opportunity to display advertising.

SUMMARY OF THE INVENTION

Accordingly, it is an object of the present invention to provide a combination totebag and towel that has at least one pocket such that the contents of the pocket do not easily spill when removing or inserting the towel into the totebag. It is also an object to provide at least one pocket that is fabricated from water resistant or waterproof fabric, and capable of being closed with a zipper.

It is another object of the invention to provide a combination totebag and towel that has at least one pocket that extends substantially the entire length of a panel of the totebag.

It is yet another object of the present invention to provide a combination totebag and towel such that the totebag is substantially hidden from view when the towel is placed face-up on the surface of a beach or the like.

It is a further object to provide a combination totebag and towel, wherein both the totebag and towel have at least one surface area suitable for advertising or other printed indicia such as a photograph or the name of a resort.

To overcome the deficiencies of the prior art and to achieve the objects listed above, a combination totebag and towel is disclosed, comprising: a sheet of readily foldable material, such as a towel, having a length and width sized to define a mat in the unfolded position, the mat having an upper edge; and a plurality of panels, each panel having an upper edge and three side edges. The upper edge of each panel is substantially aligned with the upper edge of the mat. Various edges of each panel are attached to the mat and each other so as to form a plurality of pockets therebetween.

In particular, the upper edge of a first panel is substantially adjacent to upper edge of the mat and, preferably, is attached to the mat along a plurality of its edges. Preferably, the first panel is attached to the mat along at least two edges, and most preferably, is attached along the upper edge and all three side edges of the panel. A second panel is attached to the first panel along a plurality of side edges of the first panel (most preferably all three) and a plurality of side edges of the second panel (most preferably all three) such that a first pocket is formed between the second panel and the first panel.

A third panel is attached to the second panel along a plurality of side edges of the third panel (most preferably all three) and a plurality of side edges of the second panel (most preferably all three) such that a second pocket is formed between the second panel and the third panel.

A fourth panel is attached to the third panel along a plurality of side edges of the third panel (most preferably all three) and a plurality of side edges of the fourth panel (most preferably all three). As such, a third pocket is formed between the third and fourth panel. The third pocket, in the preferred embodiment, is sufficiently large to contain the mat when the mat is in a folded position.

The mat should be capable of being folded until its length and width are no greater than and substantially equal to the first panel in size and shape, whereby the third pocket formed between the third and fourth panels can be inverted so as to enclose the mat in the totebag. A snap fastener or other fastener holds the panels together to close the bag and facilitate carrying.

An adjustable strap is secured to at least a portion of the upper edge of at least one of the panels to facilitate carrying the totebag. The strap includes a buckle and has a sufficient length that it can be used as a handle or a shoulder strap. In the preferred embodiment, the strap is attached, by stitching, to one of the panels.

In the preferred embodiment, fastening means are provided for closing at least one of the pockets. More preferably, at least one of the pockets, such as the first pocket, can be closed by a zipper. That is, a first row of teeth extend along the upper edge of the first panel, a second row of cooperating teeth extend along the upper edge of the second panel, and a slider moves along the rows of teeth to open and close the first pocket.

In the preferred embodiment, the mat and at least one of the panels comprise material suitable for displaying indicia, such as advertising. Preferably, the advertising on the panel is on a side of the panel such that when the third pocket is inverted, the indicia is displayed. In the preferred embodiment, the indicia is shown on either the third or fourth pocket, or both. The advertising on the mat can be related to the advertising on the panel, as desired.

In the preferred embodiment, the mat is folded in the following manner so as to form the totebag. First, the mat, when unfolded, is face-up to the user, and overlying the panels. The mat is then folded along fold lines traversing the length of the mat such that the width of the mat is substantially equal to the width of the panels. The mat is then folded back onto itself until it is substantially the size and shape of the panels. When properly folded, the mat is positioned over the first panel.

The third pocket, formed between the third and fourth panels, is then inverted while pulling the pocket around the mat. When the third pocket is completely inverted, the mat is substantially enclosed within the totebag.

When the totebag is inverted, the first and second pockets remain accessible to a user. Further, because the first and second pockets may be closed with fasteners, the contents of the first and second pockets do not undesirably fall out while inverting the totebag. Preferably, a zipper is used to close one of the pockets.

The invention and its particular features and advantages will become more apparent from the following detailed description when considered with reference to the accompanying drawings.

BRIEF DESCRIPTION OF THE DRAWINGS

FIG. 4 is a cross-sectional view of the totebag containing a towel in a folded position, taken along line 4—4 of FIG. 3, with the handle partially broken away;

FIG. 5 is a cross-sectional view of the totebag taken along line 5—5 of FIG. 2;

DETAILED DESCRIPTION OF THE DRAWINGS

Figure 1:
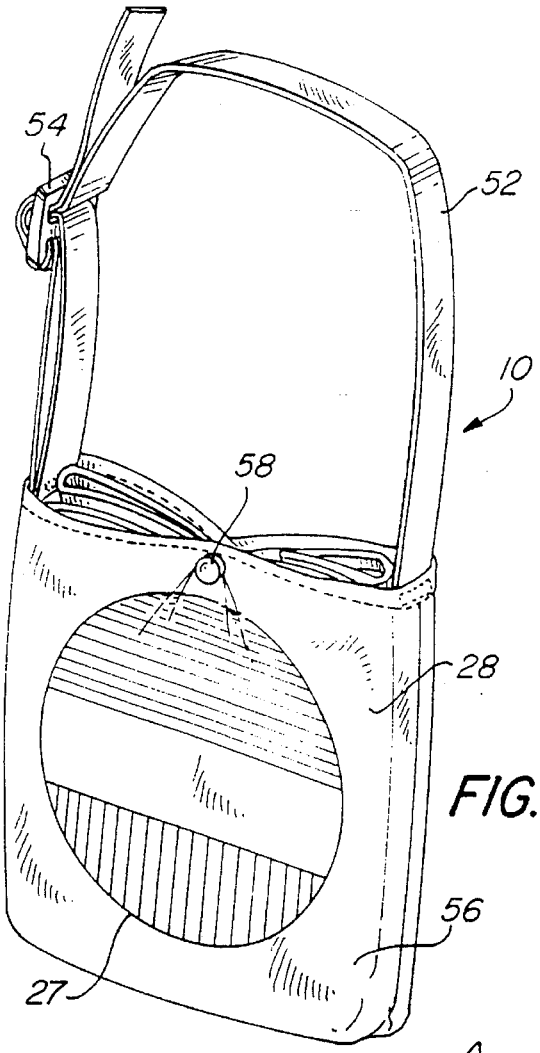
FIG. 1 is a perspective view of a combination totebag and towel with an attached handle, wherein the towel is in the folded position and neatly contained within the totebag, and showing a panel displaying indicia, such as advertising.
Figure 2:
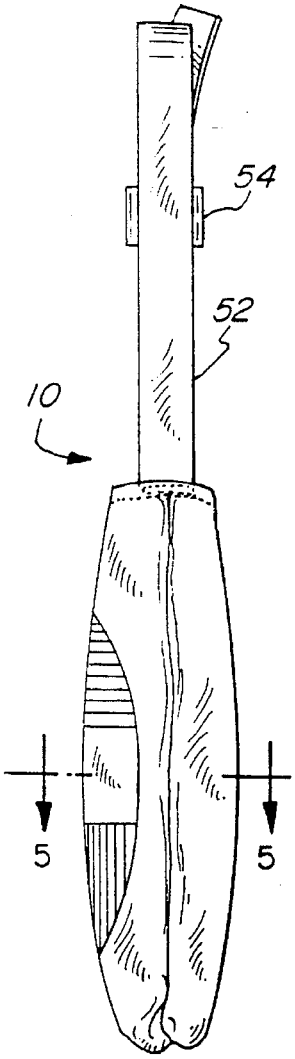
FIG. 2 is a side plan view of the totebag shown in FIG. 1.

Referring to the drawings in detail, a combination totebag and mat is shown and generally designated by the reference numeral 10. It should be noted that for the sake of clarity all the components and parts of totebag 10 may not be shown and/or marked in all the drawings. As used in this description, the terms "up", "down", "top", "bottom" etc. , refer to the combination totebag and mat 10 (sometimes referred to herein as "totebag" for convenience) when in the orientation illustrated in FIG. 1. Furthermore, as used in this description, the terms "front" and "back" also refer to the combination totebag and mat 10 when in the orientation illustrated in FIG. 1, with "front" indicating the panel of totebag 10 displaying indicia and "back" indicating the opposite panel of the combination totebag and mat 10. It will be understood, however, that totebag 10 can assume any orientation when in use.

Combination totebag and mat 10 comprises, as best shown in FIGS. 6–9, a mat 12. Mat 12 comprises a single piece of foldable sheet material, such as a towel, terry cloth material, or blanket, 12. It should be understood that any suitable material may be used for mat 12, such as a moisture-resistant material, for example a plastic, or moisture-absorbing fabric. In the preferred embodiment, towel 12 is made of material suitable for displaying indicia. Suitable materials include all-cotton materials and cotton-blend materials, which are generally known in the art.

For convenience, mat 12 may be referred to herein as a towel, but it should be understood that a plurality of fabrics or materials could be substituted.

Towel 12, in its unfolded position, is generally rectangular in shape and has a length "L" and a width "W". See FIG. 6. It should be understood that the length and width may be any suitable dimension such that, in its folded position, towel 12 fits properly within totebag 10, and in its unfolded position, towel 12 provides ample room for its intended purpose i.e., sitting or lying. In the unfolded position, towel or mat 12 may take on any suitable size and shape, as desired, depending upon its intended usage, such as for a single adult, or multiple adults, a single child, multiple children, etc.

Mat 12 has upper edge 14 and side edges 16, 18, 20, best shown when mat 12 is in the unfolded position. See FIG. 6. Mat or towel 12 further has a front side 21 and a back side 23. As used herein, front side 21 refers to that side of the mat 12 upon which one would generally lie, and which, in the preferred embodiment, displays some indicia, such as 25.

Figure 6:
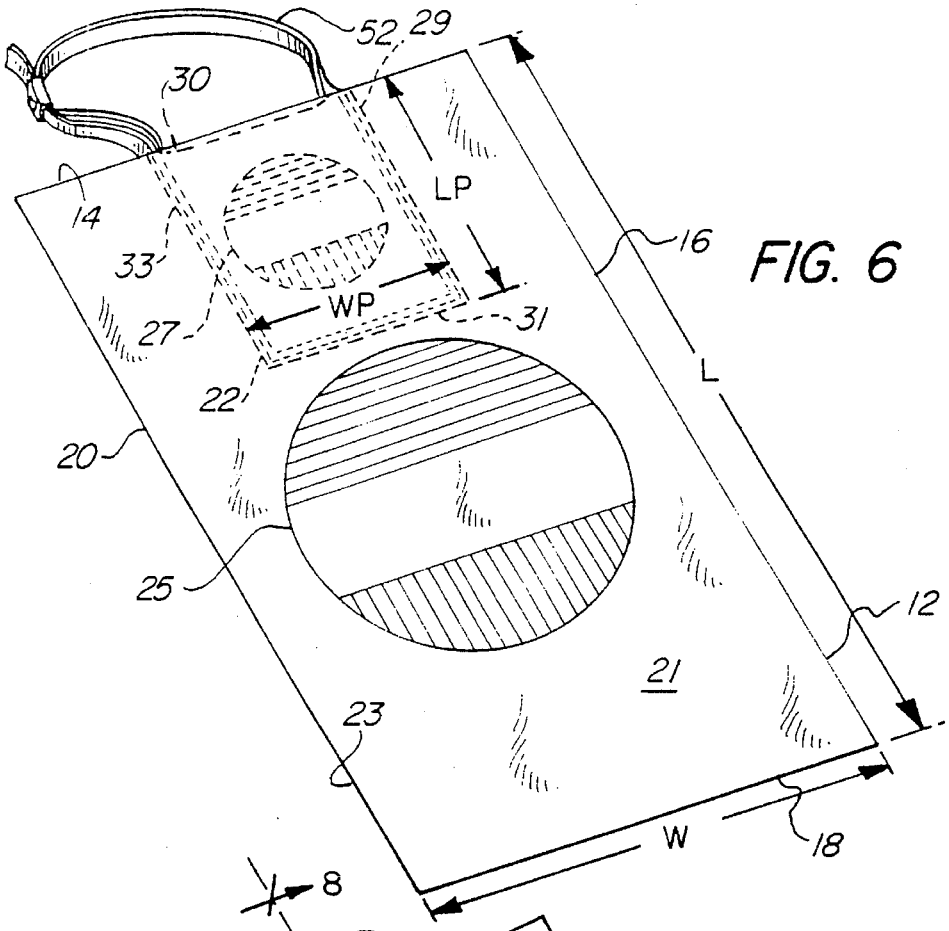
FIG. 6 is a top view of the towel removed from the totebag and in the unfolded position defining a mat upon which one can lie.
Figure 7:
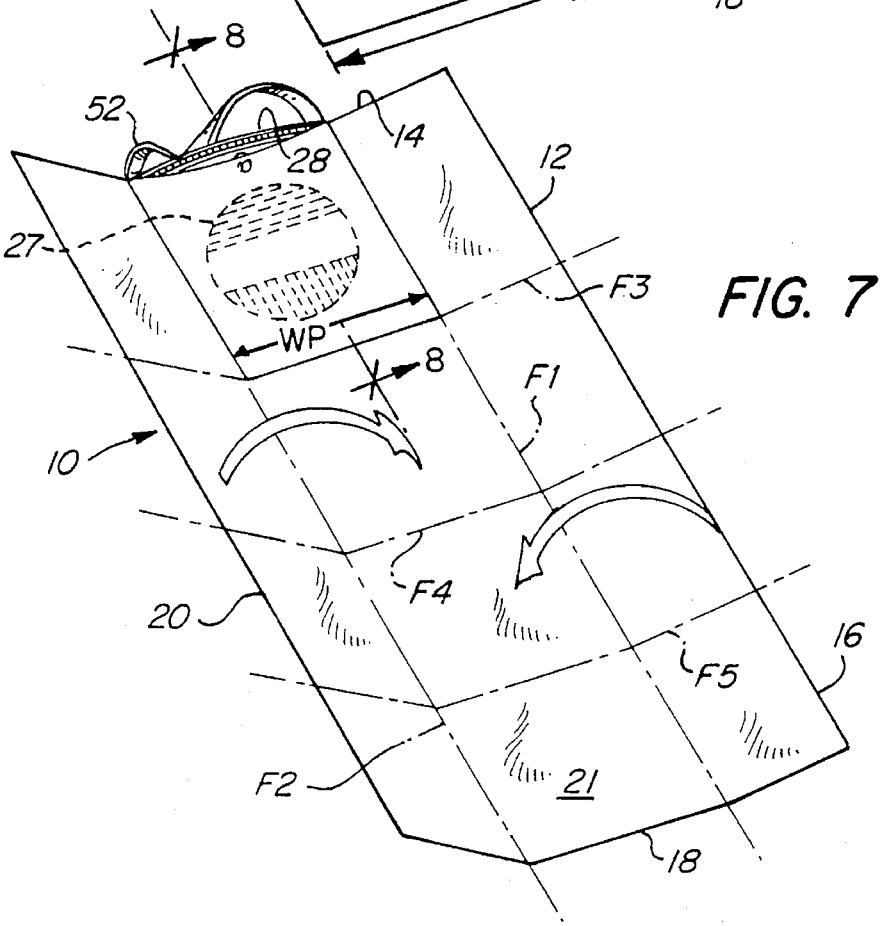
FIG. 7 is a top view of the totebag with the attached towel in the unfolded position, similar to FIG. 6, showing fold lines.
Figure 8:
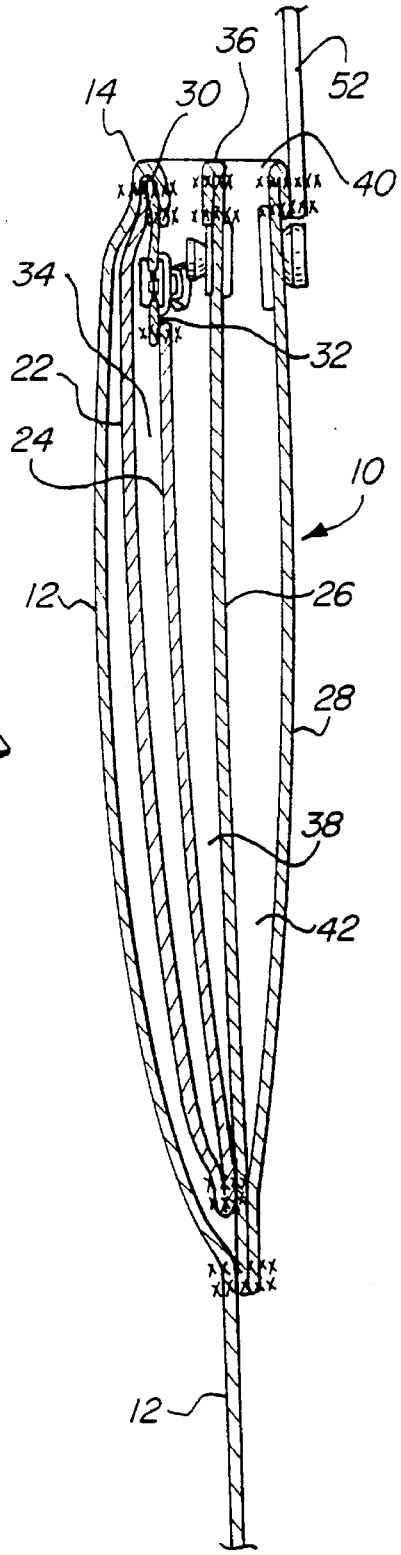
FIG. 8 is a cross-sectional view of the totebag in the unfolded position and showing the underlying panels, and with the handle partially broken away.

As best shown in FIG. 8, combination totebag and mat 10 further comprises a plurality of panels 22, 24, 26, 28. Panels 22, 24, 26, 28 are located on back side 23 (FIG. 6) of mat 12, such that when mat 12 is in the unfolded position, as shown in FIGS. 6, 7, panels 22, 24, 26, 28 are substantially hidden from view. In FIG. 6, panels 22, 24, 26, 28 are shown in dashed lines to indicate their position on backside 23 of towel 12.

Panels 22, 24, 26, 28, shown in FIG. 8, can be made of any suitable sturdy cloth of sufficient durability to, preferably, withstand harsh surfaces as may be found on the beach or ground. Preferably, panels 22 and 24 are made of nylon or other water-resistant material. Preferably, panels 26 and 28 are made of cotton sheeting or polyester twill. However, panels 22, 24, 26 and 28 can be made from any suitable fabric or material. In the preferred embodiment, at least one of the panels, most preferably third panel 26 or fourth panel 28, is made of material suitable for displaying indicia, such as 27 (FIGS. 1, 6, 7). Suitable material for displaying indicia includes all-cotton materials and cotton-blend materials, which are generally known in the art.

Panels 22, 24, 26, 28 are generally rectangular in shape. Each panel 22, 24, 26, 28 generally has the same dimensions, such as a length "LP" and width "WP". See FIG. 6. Each panel has four substantially straight edges, one edge of which is an upper edge.

First panel 22 has upper edge 30 and three side edges 29, 31, 33 and upper edge 30 of first panel 22 is substantially adjacent to upper edge 14 of mat 12. See FIG. 6. First panel 22 is attached to mat 12, preferably, along a plurality of edges of panel 22, and, most preferably, is attached along all edges 29, 30, 31, 33 of mat 12. See FIGS. 4, 8. Panel 22 may be attached by any suitable means, such as by stitching, or through the use of adhesives, VELCRO fasteners, snaps, and the like.

Second panel 24 has upper edge 32 and three side edges (not shown). It should be understood that side edges of second panel 24 are blocked from view in FIG. 6, because the location of first panel 22. Upper edge 32 of second panel 24 is, preferably, substantially adjacent to upper edge 30 of first panel 22. Second panel 24 is attached to first panel 22 along a plurality of edges and is, most preferably, attached along the three side edges of the first panel 22 and the three side edges of the second panel 24. Any method of attachment may be used, and as many edges may be attached, so long as first pocket 34 is formed between second panel 24 and first panel 22. See FIG. 8. Suitable alternatives include VELCRO fasteners, adhesives, snaps and the like. Preferably, pocket 34 is waterproof and panels 22 and 24 are made from water resistant nylon, and the pocket is closed by a zipper 44.

Figure 3:
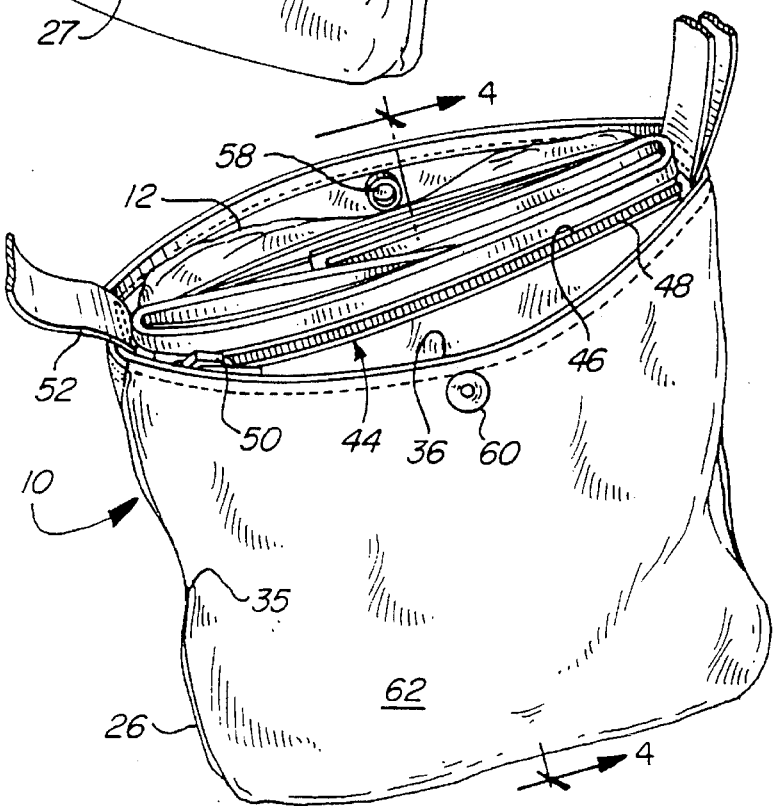
FIG. 3 is a perspective view of the totebag shown in FIG. 1, with the handle partially broken away for clarity.

Third panel 26 has upper edge 36 and three side edges, such as 35 (FIG. 3). Upper edge 36 of third panel 26 is substantially adjacent to upper edge 32 of second panel 24, when mat 12 is in the unfolded position. Third panel 26 is attached to second panel 24 along a plurality of side edges of the third panel 26 and a plurality of side edges of the second panel 24. Preferably, three side edges of each panel are attached. Again, any method of attachment may be used, and as many edges attached, such that a second pocket 38 (FIG. 8) is formed between the second panel 24 and third panel 26. Suitable alternatives include VELCRO fasteners, adhesives, snaps, and the like.

Fourth panel 28 has upper edge 40 and three side edges, such as 41 (FIGS. 13, 14), the upper edge 40 of fourth panel 28 being substantially adjacent to upper edge 36 of third panel 26, when mat 12 is in the unfolded position. Fourth panel 28 is attached to third panel 26 such that a third pocket 42 (FIG. 8) is formed between third and fourth panel, 26, 28, respectively, third pocket 42 being sufficiently large to contain mat or towel 12 when mat 12 is in a folded position, as shown in FIG. 1. Third and fourth panels 26, 28 may be attached in any suitable way. Most preferably, a plurality of edges, preferably three, of third panel 26 and a plurality, preferably three, of side edges of fourth panel 28 are attached to each other, by methods such as stitching, VELCRO fasteners, adhesives, snaps and the like.

As shown in FIG. 3, fastening means are provided for closing the pockets, such as first pocket 34, such that the contents contained therein do not spill undesirably. Any suitable means will suffice such as a zipper, snaps, buttons or the like. For example, first pocket 34 (FIG. 8), formed by first panel 22 and second panel 24 is closed by zipper 44 having a first row of teeth 46 formed along at least upper edge 30 of panel 22, a second row of teeth 48 formed along at least upper edge 32 of second panel 24, and slider 50 cooperating with first and second rows of teeth 46, 48, respectively, for joining the rows together, as desired, so as to open and close first pocket 34.

It should be noted that if a zipper, such as 44, were extended to additional edges, then those edges would not be attached to a panel to form a pocket.

In addition, the combination totebag and mat 10 may be closed, when mat 12 is in a folded position, by cooperating snaps 58, 60. See FIGS. 1, 3, 12.

Combination totebag and mat 10 further comprises an adjustable strap 52, secured to at least a portion of the upper edge of at least one of the panels, such as upper edge 36 of third panel 26. In the preferred embodiment, strap 52 is made of a sturdy cotton-blend material or polypropolene webbing. Strap 52 can be adjusted by any suitable means such as by a conventional buckle 54, best shown in FIG. 1. In a preferred form, the strap has a length sufficient to function as a handle or a shoulder strap.

In the preferred embodiment, the combination totebag and mat 10 displays indicia. Most preferably, the indicia is advertising and the advertising is shown on front side 21 of mat 12 at 25 and either or both of front side 62 of third panel 26 and/or front side 56 of fourth panel 28 of totebag 10 at 27. See FIGS. 1, 6. If desired, the advertising on the panel can be related to, or coordinated with, the advertising on towel 12. For example, one could show a beach scene on front side 21 of towel 12 and a sunscreen lotion logo on front side 56 (FIG. 13) of fourth panel 28. In certain instances a high quality printed photographic image can be placed on the towel and the bag using a process developed by applicant's assignee and sold under the MATRIX Grand.

It should be understood that indicia 27 can be displayed on front side 56 of fourth panel 28, or front side 62 of third panel 26, or both. Indicia may be displayed on any panel so long as the indicia is displayed when third pocket 42 is inverted.

In the preferred embodiment, the combination totebag and mat 10 is converted from the unfolded position, shown in FIG. 6, to the folded position, shown in FIG. 1, in the following manner so as to form the combination totebag and mat 10. First, mat 12, when unfolded, has face side 21 facing the user. As such, mat 12 overlies panels 22, 24, 26, 28 and substantially hides them from view of passersby. See FIGS. 6, 7.

Figure 9:
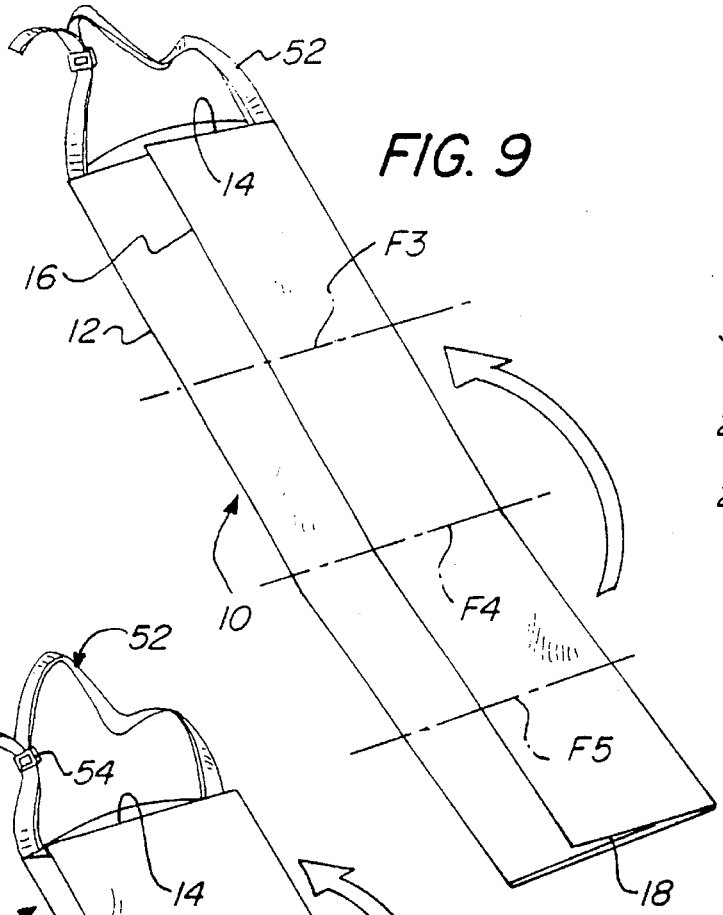
FIGS. 9–14 show steps of folding the towel for proper insertion into the totebag and inverting one of the pockets, such that the towel is contained within the totebag and the advertising is displayed on the outside of the totebag when properly completed, showing the handle partially broken away in FIGS. 12–14.
Figure 10:
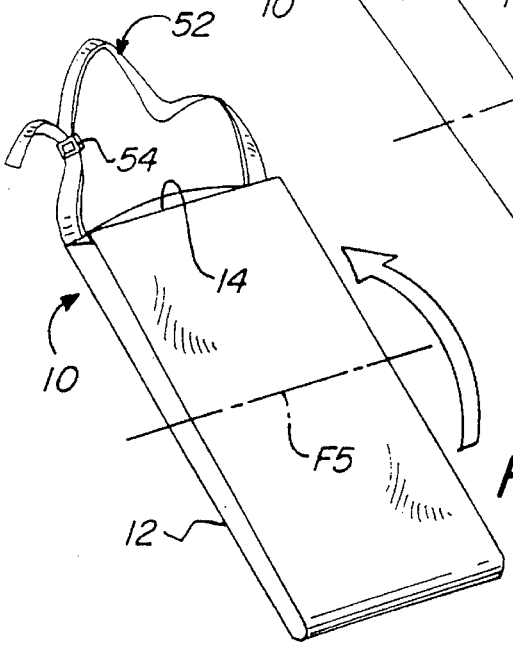
Figure 11:
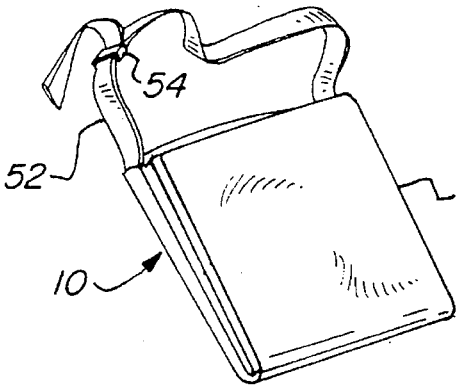

Mat 12 is then folded, in the direction of the arrows in FIG. 7, along fold lines F1 and F2 traversing the length L of mat 12 such that the width of mat 12 in the folded position is substantially equal to the width "WP" (FIG. 6) of panels 22, 24, 26, 28. See FIGS. 9–11. Mat 12 is then folded back onto itself, along foldlines F3, F4, F5, as shown in FIGS. 7, 9, 10, until mat 12 is substantially the size and shape of panels 22, 24, 26, 28, as shown in FIG. 11. When properly folded, mat 12 is substantially the size and shape of first panel 22 and is substantially positioned over first panel 22, as shown in FIG. 11. Preferably, the towel or mat is face up when folded.

Third pocket 42, formed between third and fourth panels, 26, 28, respectively, is then inverted, in the direction of the arrows, while pulling third pocket 42 around folded mat 12. See FIGS. 12–14. When third pocket 42 is completely inverted, mat 12 is substantially enclosed within the combination totebag and mat 10, as best shown in FIGS. 1, 3. When inverted, indicia 27 is clearly visible.

Figure 12:
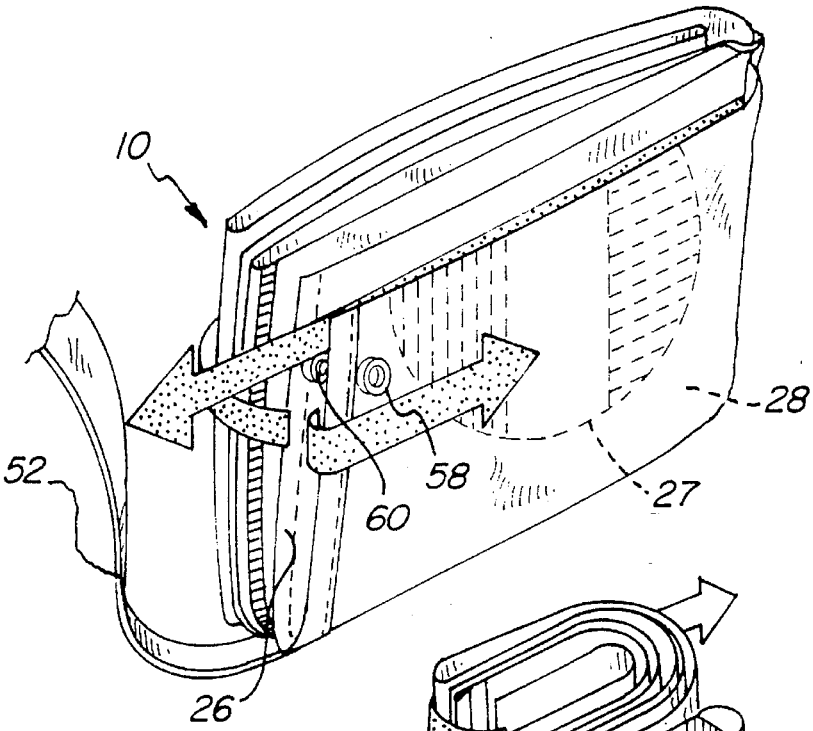
Figure 13:
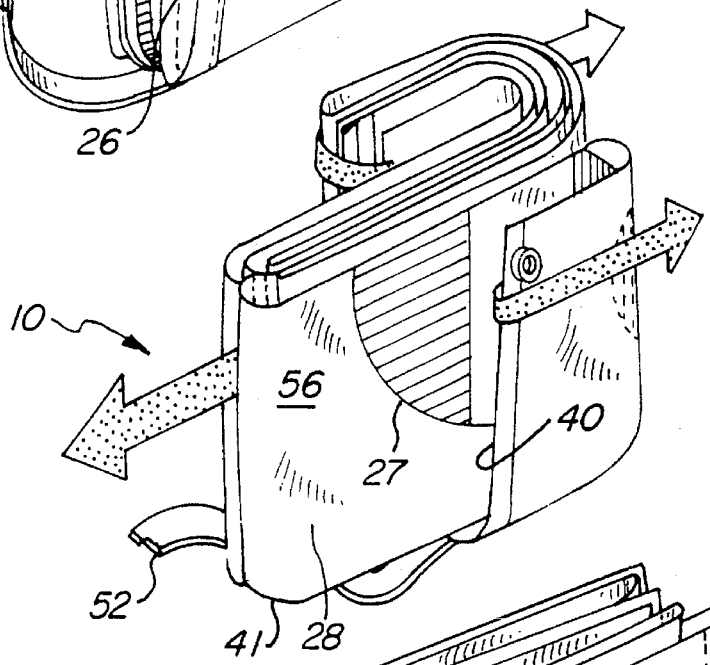
Figure 14:
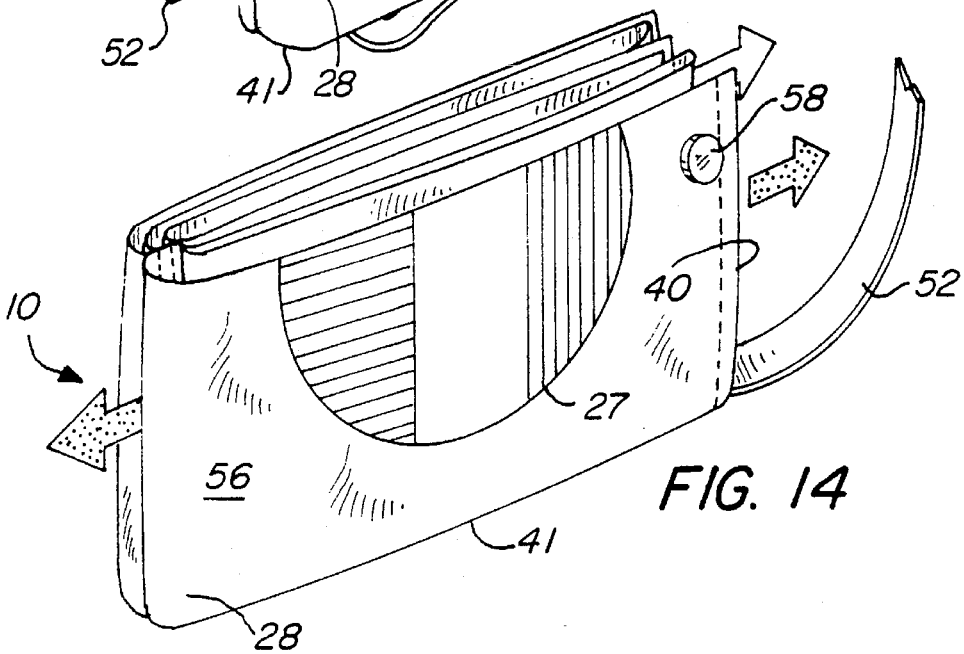

When totebag 10 is inverted, first and second pockets 34, 38 remain accessible to a user. Further, because first and second pockets 34, 38 may be closed with fasteners, the contents of first and second pockets 34, 38 do not undesirably fall out while inverting totebag 10, as shown in FIGS. 12–14.

It should be understood that the totebag and mat 10 described herein has been described in terms of beach gear for convenience only. Totebag and mat 10 can be used anywhere one would like to sit or lie upon a mat.

It should be understood by those skilled in the art that obvious modifications can be made without departing from the spirit of the invention. Accordingly, reference should be made primarily to the accompanying claims, rather than the foregoing specification, to determine the scope of the invention.

I claim:

1. A combination totebag and mat comprising:

a sheet of readily foldable material having a predetermined length and width sized to define a mat such that the lower edge of the mat extends below the lower edge of the first panel the mat having an upper edge and a lower edge;

a totebag comprising:

a first panel having an upper edge a lower edge and at least three side edges, the upper edge of the first panel being substantially adjacent to the upper edge of the mat, the first panel being attached to the mat along at least two edges of the panel;

a second panel having an upper edge and three side edges, the upper edge of the second panel being substantially adjacent to the upper edge of the first panel, the second panel being attached to the first panel along the at least two side edges of the first panel and the three side edges of the second panel such that a first pocket is formed between the second panel and the first panel;

a third panel having an upper edge and three side edges, the upper edge of the third panel being substantially adjacent to the upper edge of the second panel, the third panel being attached to the second panel along the three side edges of the third panel and the three side edges of the second panel such that a second pocket is formed between the second panel and the third panel; and a fourth panel having an upper edge and three side edges, the upper edge of the fourth panel being substantially adjacent to the upper edge of the third panel, the fourth panel being attached to the third panel along the three side edges of the third panel and the three side edges of the fourth panel such that a third pocket is formed between the third and fourth panels, the third pocket formed between the third and fourth panels being open along the upper edge of the third and fourth panels, the third pocket being sufficiently large to contain the mat when the mat is folded; and whereby at least one of the pockets, when inverted, substantially encloses the mat in the totebag.

2. The combination totebag and mat of claim 1, further comprising an adjustable strap secured to at least a portion of the upper edge of at least one of the panels, the strap being adjustable to be a handle or a shoulder strap.

3. The combination totebag and mat of claim 1, further comprising fastening means for closing at least one of the pockets, and wherein at least one of the pockets is waterproof.

4. The combination totebag and mat of claim 1, wherein the mat and at least one of the panels comprises material suitable for displaying indicia.

5. The combination totebag and mat of claim 4, wherein the indicia comprises advertising.

6. The combination totebag and mat of claim 5, wherein the fourth panel displays advertising.

7. The combination totebag and mat of claim 6, wherein the advertising on the mat is related to the advertising on the fourth panel.

8. The combination totebag and mat of claim 1, the first and second panels being comprised of water-resistant material, so as to form a water-resistant pocket therebetween, and the pocket being accessible through a zipper.

9. A combination totebag and mat comprising:

a sheet of readily foldable material sized to define a mat the mat having an upper edge and a lower edge, a front side and a back side;

a plurality of panels, each panel having an upper edge a lower edge and at least two side edges and having dimensions substantially smaller than the dimensions of the sheet, the plurality of panels comprising at least a first panel and a second panel, the first panel attached to the back side of the mat along at least two of the at least two side edges of the first panel and positioned such that the upper edge of the first panel is substantially adjacent to the upper edge of the sheet and the lower edge of the sheet extends below the lower edge of the first panel, and the second panel, attached to the first panel and positioned such that the upper edge of the second panel is substantially adjacent to the upper edge of the first panel, so as to form a pocket therebetween, the pocket being open along the upper edge of the first and second panels; and whereby when the pocket is inverted, the mat is substantially enclosed within the pocket of the totebag.

10. The combination totebag and mat of claim 9, further comprising an adjustable strap secured to at least a portion of the upper edge of at least one of the panels.

11. The combination totebag and mat of claim 9, further comprising fastening means for closing the pocket.

12. The combination totebag and mat of claim 9, wherein the mat and at least one of the panels further comprise material suitable for displaying indicia.

13. The combination totebag and mat of claim 12, wherein the indicia comprises advertising.

14. A combination totebag and mat comprising:

a readily foldable towel having a predetermined length and width sized to define a mat, the towel having an upper edge and a lower edge;

a totebag comprising:

a first panel having an upper edge a lower edge and at least two side edges, the upper edge of the first panel being substantially adjacent to the upper edge of the towel such that the lower edge of the towel extends below the lower edge of the first panel, the first panel being attached to the towel along a plurality of edges of the panel;

a second panel having an upper edge and three side edges, the upper edge of the second panel being substantially adjacent to the upper edge of the first panel, the second panel being attached to the first panel along the at least two side edges of the first panel and the three side edges of the second panel such that a first pocket is formed between the second panel and the first panel;

a third panel having an upper edge and three side edges, the upper edge of the third panel being substantially adjacent to the upper edge of the second panel, the third panel being attached to the second panel along the three side edges of the third panel and the three side edges of the second panel such that a second pocket is formed between the second panel and the third panel; and a fourth panel having an upper edge and three side edges, the upper edge of the fourth panel being substantially adjacent to the upper edge of the third panel, the fourth panel being attached to the third panel along the three side edges of the third panel and the three side edges of the fourth panel such that a third pocket is formed between the third and fourth panels, the third pocket being open along the upper edge of the third and fourth panels, the pocket formed between the third and fourth panels being sufficiently large to contain the towel when the towel is folded;

the pocket formed between the third and fourth panels, when inverted, substantially encloses the towel in the totebag; and fastening means for closing at least one of the first and second pockets such that any items contained within the at least one of the first and second pockets remains within the respective pocket when the third pocket is inverted.

15. The combination totebag and mat of claim 14, further comprising an adjustable strap secured to at least a portion of the upper edge of at least one of the panels.

16. The combination totebag and mat of claim 14, wherein the towel and at least one of the panels comprise material suitable for displaying indicia.

17. The combination totebag and mat of claim 16, wherein the indicia comprises advertising.

18. The combination totebag and mat of claim 17, wherein the fourth panel displays advertising.

19. A combination totebag and mat comprising:

a sheet of readily foldable material having a predetermined length and width sized to define a mat the sheet having an upper edge and a lower edge; and a totebag comprising a plurality of panels, each of the panels having an upper edge a lower edge and at least two side edges and having dimensions substantially smaller than the dimensions of the sheet, the panels positioned on one side of the sheet, at least one of the panels attached at least partially to the sheet and positioned such that the upper edge of the at least one panel is substantially adjacent to the upper edge of the sheet and the lower edge of the sheet extends below the lower edge of the at least one panel, and each of the remaining panels attached at least partially to each other and at least one of the remaining panels being attached to the at least one panel attached to the sheet, at least one pocket formed between adjacent panels of the plurality of panels, the at least one pocket having an opening defined by the upper edges of the adjacent panels wherein at least one of the pockets, when inverted, encloses the sheet in the totebag.

20. The combination totebag and mat of claim 19, further comprising an adjustable strap secured to at least a portion of at least one of the panels, the strap being adjustable to be a handle or a shoulder strap.

21. The combination totebag and mat of claim 19, further comprising fastening means for closing at least one of the pockets.

22. The combination totebag and mat of claim 19, wherein the mat and at least one of the panels comprises material suitable for displaying indicia.

23. The combination totebag and mat of claim 22, wherein the indicia comprises advertising.

24. The combination totebag and mat of claim 19, at least two of the panels being comprised of water-resistant material, so as to form a water-resistant pocket therebetween.

* * * * *